US006292156B1

(12) United States Patent
Openlander

(10) Patent No.: US 6,292,156 B1
(45) **Date of Patent: *Sep. 18, 2001**

(54) LOW VISIBILITY RADIO ANTENNA WITH DUAL POLARIZATION

(75) Inventor: Wayne R. Openlander, Chicago, IL (US)

(73) Assignee: Antenex, Inc., Glendale, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/430,827

(22) Filed: Oct. 29, 1999

Related U.S. Application Data

(63) Continuation of application No. 08/892,732, filed on Jul. 15, 1997, now Pat. No. 5,977,931.

(51) Int. Cl.[7] ..... H01Q 1/36
(52) U.S. Cl. ..... 343/895; 343/872; 29/600
(58) Field of Search ..... 343/895, 872, 343/700 MS; 26/900

(56) References Cited

U.S. PATENT DOCUMENTS

| | | | |
|---|---|---|---|
| 1,581,133 | 4/1926 | Mackenzie | 267/74 |
| 1,911,234 | 5/1933 | Meyer | 343/823 |
| 2,094,108 | 9/1937 | Ryall | 179/78 |
| 2,712,604 | 7/1955 | Thomas, Jr. et al. | 250/33 |
| 2,802,210 | 8/1957 | Berndt | 343/792 |
| 2,945,084 | 7/1960 | Daggett | 174/86 |
| 2,953,786 | 9/1960 | Krause | 343/895 |
| 2,963,704 | 12/1960 | Yates et al. | 343/895 |
| 2,966,678 | 12/1960 | Harris | 343/809 |
| 2,966,679 | 12/1960 | Harris | 343/895 |
| 3,199,108 | 8/1965 | Munk | 343/718 |
| 3,246,245 | 4/1966 | Turner | 325/442 |
| 3,264,647 | 8/1966 | Nuttle | 343/745 |
| 3,296,536 | 1/1967 | Copeland et al. | 325/449 |
| 3,383,695 | 5/1968 | Jarek | 343/895 |
| 3,386,033 | 5/1968 | Copeland et al. | 325/373 |
| 3,396,396 | 8/1968 | Charlton et al. | 343/708 |
| 3,474,453 | 10/1969 | Ireland | 343/745 |
| 3,487,463 | 12/1969 | Rogers | 343/708 |
| 3,523,251 | 8/1970 | Halstead | 325/373 |
| 3,623,113 | 11/1971 | Faigen et al. | 343/747 |
| 3,624,662 | 11/1971 | Feder | 343/715 |
| 3,720,874 | 3/1973 | Gorcik et al. | 325/16 |
| 3,781,899 | 12/1973 | Lockwood | 343/880 |
| 3,858,220 | 12/1974 | Arnow | 343/802 |
| 3,932,873 | 1/1976 | Garcia | 343/792 |

(List continued on next page.)

OTHER PUBLICATIONS

Kuboyama, Haruhiro et al., "Experimental Results with Mobile Antennas Having Cross–Polarization Components in Urban and Rural Areas," *IEEE Transactions on Vehicular Technology*, vol. 39, No. 2, 150–160.

*Primary Examiner*—Tan Ho
(74) *Attorney, Agent, or Firm*—Cislo & Thomas, LLP

(57) ABSTRACT

A low visibility, field-diverse antenna provides cross-polarized fields enhancing signal communications. A generally flat, but helical, antenna is achieved in conjunction with a core substrate about which the antenna is wrapped, wound, or fixed. The core substrate, pitch or angle of the helix, and length of the transmitting antenna are chosen for a specific resonant frequency. The length and width of the helix are chosen in order to dimension the helical antenna between its linear and circular polarization modes to thereby deliver field-diverse and cross-polarized transmission modes. In order to optimize the manufacturing process, holes may be created within the substrate. These holes are plated with conducting material so that conducting foil on opposite faces of the substrate may be electrically connected. The holes may be offset according to the pitch of the helix. Once the transmitting antenna has been fabricated upon the core substrate, the margin between the plated-through holes and the edge of the substrate may be separated by cutting, sawing, or stamping.

24 Claims, 4 Drawing Sheets

U.S. PATENT DOCUMENTS

| | | | |
|---|---|---|---|
| 3,961,332 | 6/1976 | Middlemark | 343/802 |
| 4,028,704 | 6/1977 | Blass | 343/715 |
| 4,117,493 | 9/1978 | Altmayer | 343/750 |
| 4,117,495 | 9/1978 | Hochstein | 343/877 |
| 4,163,981 | 8/1979 | Wilson | 343/715 |
| 4,229,743 | 10/1980 | Vo et al. | 343/749 |
| 4,442,436 | 4/1984 | Newcomb | 343/722 |
| 4,442,438 | 4/1984 | Siwiak et al. | 343/792 |
| 4,494,117 | 1/1985 | Coleman | 343/365 |
| 4,494,120 | 1/1985 | Garay | 343/702 |
| 4,494,122 | 1/1985 | Garay et al. | 343/722 |
| 4,504,834 | 3/1985 | Garay et al. | 343/749 |
| 4,571,595 | 2/1986 | Phillips et al. | 343/745 |
| 4,730,195 | 3/1988 | Phillips et al. | 343/792 |
| 4,849,767 | 7/1989 | Naitou | 343/745 |
| 5,300,940 | 4/1994 | Simmons | 343/749 |
| 5,412,392 | 5/1995 | Tsunekawa | 343/702 |
| 5,977,931 * | 11/1999 | Openlander | 343/895 |
| 5,990,848 * | 11/1999 | Annamaa et al. | 343/895 |

* cited by examiner

LOW VISIBILITY RADIO ANTENNA WITH DUAL POLARIZATION

CROSS-REFERENCES TO RELATED APPLICATIONS

This application is a continuation of U.S. patent application Ser. No. 08/892,732 filed on Jul. 15, 1997 and to be issued on Nov. 2, 1999 as U.S. Pat. No. 5,977,931, incorporated herein by this reference thereto.

BACKGROUND OF THE INVENTION

1. Field of the Invention

This invention relates to antennas and more particularly an antenna that uses cross-polarization with either a ground plane or no ground plane to provide enhanced telecommunications or the like.

2. Description of the Related Art

All forms of radio or similar telecommunications require an antenna in order to transmit and receive radio waves and the like for communication. With increasing cellular communications and short-distance telecommunications, antennas are becoming more a part of the commonplace environment. Particularly with cellular telephones, the power supplies for the antenna associated with the cellular phone is powered by a battery and is consequently limited in power and duration of the power supply. Due to these power and other limitations, it is important to provide an antenna that maximizes the efficiency of the available power, to transmit a clear signal as far as possible.

Stationary and other antennas, such as those mounted on cars and the like, are generally within easy reach of passersby or pedestrians. Such easy access makes such antennas often subject to vandalism or other unwanted attention. By making such antennas as inconspicuous as possible, undesired attention can be avoided and the useful life of the antenna can be extended. In order to achieve low visibility, the antenna must achieve a compact size through packaging and possibly disguised or non-traditional antenna shapes.

In the art, it is known that destructive interference occurs when reflected signals destructively interfere with transmitted signals. This is known Raleigh fading and creates signal fading or dead spots that inhibit or diminish the desired communications for which cellular phones and the like are intended. In designing an antenna meant for daily or commonplace use in a cellular or similar environment, an advantageous antenna design avoiding Raleigh fading is not currently available and is something that would well serve the advancement of the telecommunications arts.

In order to decrease the apparent size of a monopole antenna, the antenna can be shortened by making the antenna in the shape of a spring, or coil, by winding it around a cylindrical core in the manner of a helix or otherwise. Such helical antennas are described in detail in Kraus, *Antennas,* Chapter 7, pp. 173–216 (McGraw Hill 1950) and in a number of U.S. patents. A practical example of a linearly polarized antenna may be found in the *ARRL Antenna Handbook,* "Short Continuously Loaded Vertical Antennas," pp. 6–18 to 6–19 (Gerald Hall ed., ARRL Press 1991).

Helical antennas may be made from wire or metal tape wrapped around a cylindrical core made of plastic or plastic-glass composite. In winding the antenna around the core, the length of the antenna and the pitch at which it is wound around the core are fashioned so that the resulting antenna is resonant at a desired frequency. A shortened antenna has the radiation resistance and consequent narrow band width of a straight length wire of the same length. However, with the coiling of the wire about the core, an inductance is introduced that approximately cancels the series radiation capacitance of the equivalent short wire antenna.

The narrow bandwidth of such inductively shortened antennas can be used to good effect at frequencies below 30 MHz, where they enjoy frequent use. However, at higher frequencies, wider bandwidths are required and the narrow bandwidth of such antennas prevent them from being used at such higher frequencies. In order to compensate for the narrow bandwidth of the inductively-shortened antenna, common practice includes tuning means so that the frequency may be tuned by either expanding or contracting the length of the helix, or by adding resistances in series with the low radiation resistance of the antenna. This is shown in the patent to Simmons, Broadband [Helical] Antenna (U.S. Pat. No. 5,300,940 issued Apr. 5, 1994). By accommodating and compensating for the narrow bandwidth, an improvement is made in the apparent bandwidth in the VSWR (voltage standing wave ratio) of the antenna but at the expense of radiation efficiency. Of course, radiation efficiency is especially important for battery-powered transmitters and for those transmitters that are a significant distance (near the periphery of the transmitting range) from a cellular or other receiver.

Where tuning is impractical and/or where high efficiency is required, some additional bandwidth may be gained by making the helix larger in diameter thereby increasing the width to length ratio. However, as mentioned in the Kraus reference above, as the diameter of the helix is increased and as the pitch and length of the turns are adjusted to maintain the resonance of the antenna, the polarization of the resulting antenna changes from dispersive linear radiation to endfire circular radiation. This change of direction of radiation from broadside to endfire is generally impractical for mobile and portable applications. Such high directivity and such an unfavored angle of radiation impose certain inconveniences and limitations upon small transmitters and their antennas. However, there are some uses for an endfiring helical antenna such as those which are described in the patent to Wheeler entitled Antenna Systems (U.S. Pat. No. 2,495,399 issued January 1950).

Field diversity, that is the diversity in the polarization of the vertical and horizontal field components, is known to address and to help resolve Raleigh fading. K. Fujimoto and J. R. James, *Mobile Antenna Systems Handbook*, pp. 78–85 (Artech House 1994), A. Santamaria and F. J. Lopez-Hernandez, *Wireless LAN Systems*, p. 180 (Artech House 1994). The advantages arising from cross-polarized radio signals is also addressed in "Experimental Results with Mobile Antennas Having Cross-Polarization Components in Urban and Rural Areas," Kuboyama et al., *IEEE Transactions on Vehicular Technology*, Vol. 39, No. 2, May 1990, pp. 150–160. Field diversity, or cross-polarization, results when the horizontal and vertical field components of the radiated signal are radiated in phase. This is in opposition to circular polarization, which occurs when the horizontal and vertical field components are plus or minus 90 degrees out of phase and to the situations where only horizontal or vertical field components are present exclusively.

In order to obtain field diversity from an antenna, particularly a helical antenna, the helical antenna must be dimensioned between its linear and circular polarization modes in order to achieve field diversity. One such helical antenna is illustrated in FIG. 1 of the patent to Halstead, Structure with an Integrated Amplifier Responsive to Signals of Varied Polarization (U.S. Pat. No. 3,523,351 issued August 1970). As an alternative to the helical structure of the antenna, meander lines can be used as set forth in the patent to Drewett, Helical Radio Antenna (U.S. Pat. No. 4,160,979 issued Jul. 10, 1979). Radomes are also known in the art per the patent to Frese, Helical UHF Transmitting and Receiving Antenna (U.S. Pat. No. 5,146,235 issued Sep. 8, 1992).

Despite the established art and current developments thereof, the use of field diversity in a small antenna for cellular or similar use is not known in the art. Additionally, such antennas would provide significant advantage as radio telecommunications could then also take place in conjunction with a variety of different objects such as vending machines, as well as individuals with their cellular phones and other electronic data and information machines. To achieve greater utility, such an antenna should function well with or without ground planes and should provide impedance matching and compensating circuitry to maximize the bandwidth of the antenna.

SUMMARY OF THE INVENTION

The low visibility, field diverse radio antenna of the present invention transmits its signals using dual polarization to obtain field diversity. A generally small (on the order of a few inches), thin, and rectangular printed circuit board is wrapped with conducting foil or the like with plated-through holes providing conduction between the two large flat sides of the rectangle. The antenna is wound about the substrate for a preferred resonant frequency. Alternatively, foil can be laid in between offset plated-through holes in order to obtain the helix configuration. The plated-through holes provide easy means by which such an antenna can be fabricated as upon application of the antenna foil, the margin of the substrate external to the plated-through holes can be removed by sawing, routing, or stamping.

The flat helix configuration may be square in shape and delivers a field diverse transmission signature that diminishes Raleigh fading, signal fading, and dead spots. The dimensions of the resulting field diverse antenna are important, as they establish the base resonant frequency about which the antenna will naturally resonate. A radome enclosure is used to encapsulate and cover the antenna and may serve to camouflage or disguise the antenna so that it attracts less attention and will be less subject to vandalism or mischief. The radome may be cylindrical or rectangular in nature according to the dimensions of the enclosed antenna. Industry standard mounts can be used in conjunction with the constant impedance section to eliminate the need for impedance matching or allow convenient attachment of alternative or additional impedance matching networks. In the embodiment described herein, elevation of the antenna somewhat above the ground plane lowers the radiation angle.

Tuning of the antenna may be achieved by the addition of small inductors at strategic places in the antenna circuit. Also, the operating frequency of the antenna can be changed by the thickness of the covering plastic radome. This is particularly true if the radome is constructed of a dense plastic such as acetyl (often marketed under the brand name of Delrin®) having a dielectric constant of about 4. Specific embodiments of the antenna of the present invention and are described in further detail below.

OBJECTS OF THE INVENTION

It is an object of the present invention to provide a low visibility antenna that avoids Raleigh fading during transmission.

It is an additional object of the present invention to provide a low visibility antenna that radiates in a field-diverse manner.

It is yet another object of the present invention to provide a method of manufacturing a low visibility field diverse antenna.

It is an object of the present invention to provide a low visibility field-diverse antenna that matches industry standard connections, can receive an impedance matching network, and that can maximize radiative efficiencies.

These and other objects and advantages of the present invention will be apparent from a review of the following specification and accompanying drawings.

DESCRIPTION OF THE PREFERRED EMBODIMENTS

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

The present invention provides means by which small, low-power antennas can achieve better signal transmission and power efficiencies while avoiding intentional, mischievous destruction.

Figure 1:
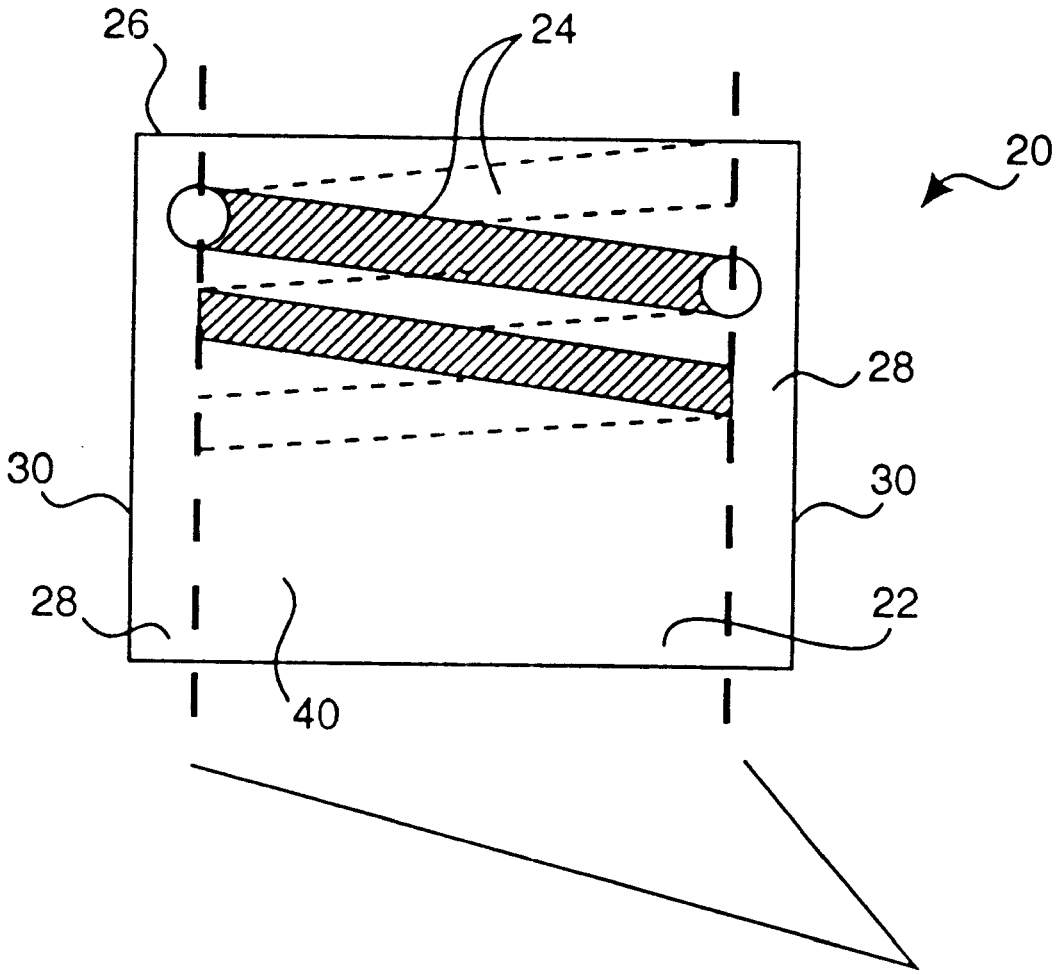
FIG. 1 is a front plan view of an antenna constructed according to the present invention during the construction process.

As shown in FIG. 1, the low visibility, field-diverse antenna of the present invention 20 has a rigid supporting substrate 22 upon which a conductor 24 (such as conducting metal foil) is applied, attached, fixed, or wound. In this way, a relatively long length of conductor (acting as the transmitting antenna) can be held or enclosed in a generally small space. As the length of the transmitting antenna generally determines the resonant frequency, providing a helical, coiled, or otherwise wound conductor 24 in a small space provides for lower visibility and a diminished chance of vandalism and mischief directed against the mechanical structure of the antenna.

While the conductor 24 of the antenna 20 may be wound about the perimeter of the rigid supporting substrate 22, in the preferred embodiment, holes 26 may be inscribed, drilled, or otherwise installed into the supporting substrate 22. After the holes 26 have been created in the substrate 22, the interiors of the holes 26 are plated or otherwise made conducting so that when the conductor 24 comes into contact with the plating, conduction can be achieved from one flat side of the substrate 22 to the other.

As shown in FIG. 1, strips of conducting foil 24 travel along the front side of the substrate 22 with corresponding foil strips 24 shown in phantom travelling on the back side of the substrate 22.

In order to obtain a helical configuration by the conductor 24 as it travels along the exterior of the substrate 22, the holes 26 are offset according to the angle of pitch that the helix formed by the conductor 24 obtains when it is affixed to the substrate. This angle of pitch is important as it controls the measure of induction that the helix obtains as an inductor. The permittivity and/or permeability of the substrate 22 may also be a factor of the magnitude of the inductive effect created by the helical conductor 24 and may be accommodated by the offset of the holes 26.

As can be seen by inspection of FIG. 1, the holes 26 intermediating the strips of conductor 24 to achieve the helical transmitting antenna, are situated in a spaced apart relation with the outermost edge of the substrate 22 to create a margin 28 separating the edge 30 of the substrate 22 from the holes 26.

Upon completion of the antenna affixing process where the conducting foil 24 is fixed to the opposite faces of the substrate 22 and intermediated by the plated-through holes 26, the margin 28 can be removed from the center portion 40 of substrate 22. This removal process generally entails cutting the margin 28 off from the center portion 40 along the center of the holes 26. Additional margin may be cut away by expanding the margin and increasing the center portion during the cutting process so long as the conducting foil 24 is not torn, broken, or otherwise injured. The holes 26 may be made of sufficiently large diameter, on the order of fifty thousandths of an inch (0.050"), to make removal of the margin 28 easier. With such diameter holes 26, the cutting, sawing, or stamping process does little damage to the connecting foil and expensive tooling is not needed to reduce the size of the antenna 20 by removing the margin 28.

Having properly chosen the dimensions and properly applied the materials of the antenna 20 as shown in FIG. 1, the predominant portion of the antenna has been created. The pitch and width of the helix, the length and width of the conductor 24, the permittivity and permeability of the substrate 22, as well as the frequencies involved all affect the operating characteristics of the antenna of the current invention and provide means by which such antennas may be tuned by altering the characteristics of these and other parameters. While simple in construction, the antenna 20 constructed along the lines of the present invention is electronically sophisticated and reflects this sophistication in its transmission characteristics of field diversity coupled with low visibility and energy efficiency. By providing a low visibility field diverse antenna transmitting in a plurality of polarities, Raleigh fading, signal fading, and dead spots are reduced by avoiding destructive interference while signal transmission is correspondingly enhanced in accordance with the power restrictions for weak or low power transmitters. By providing such an antenna, cellular and other personal communications become greatly enhanced as they are more reliable within the confines of the power restrictions involved.

Figure 2:
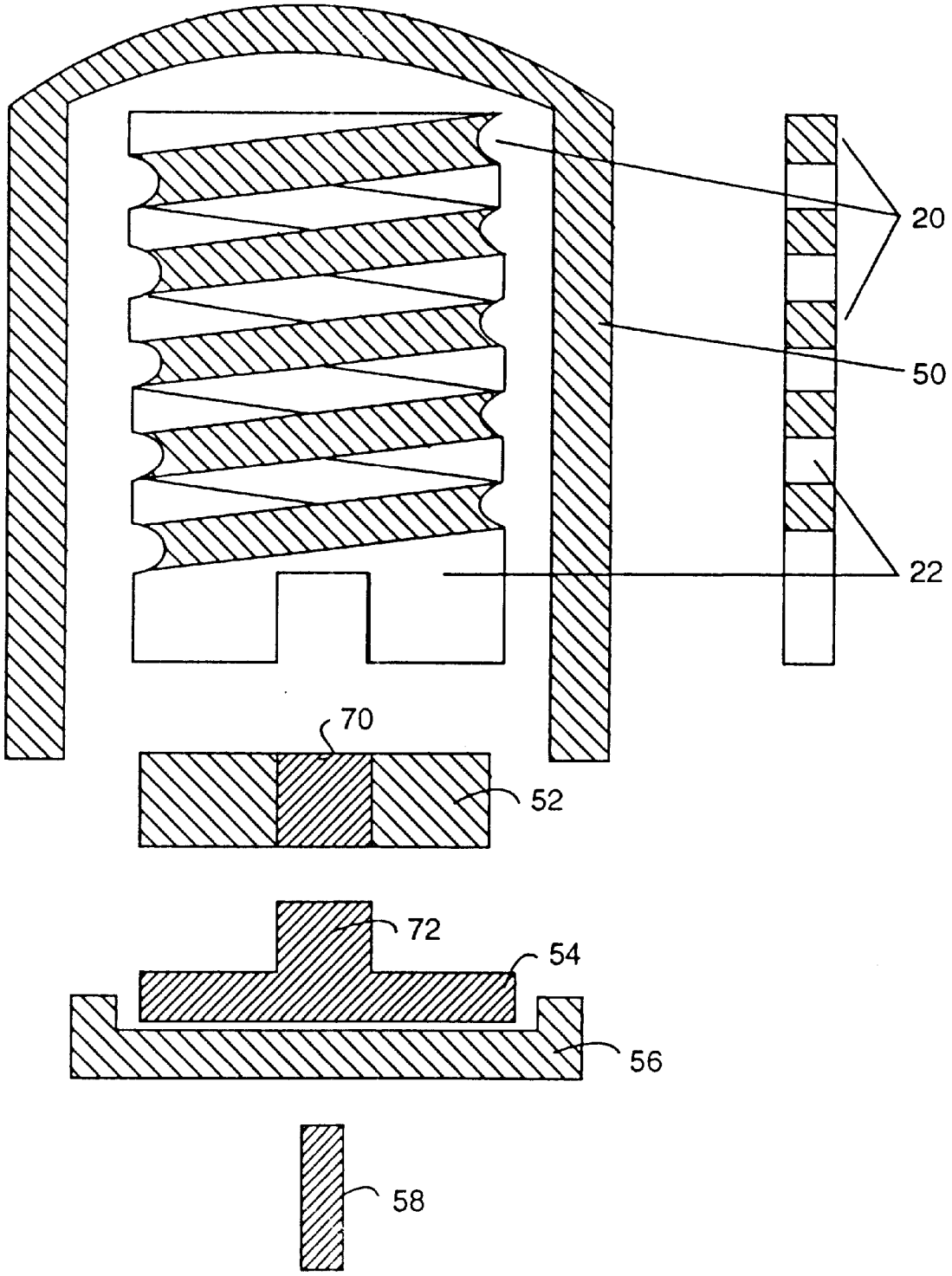
FIG. 2 is a dual cross-sectional view of an antenna constructed according to the present invention.
Figure 3:
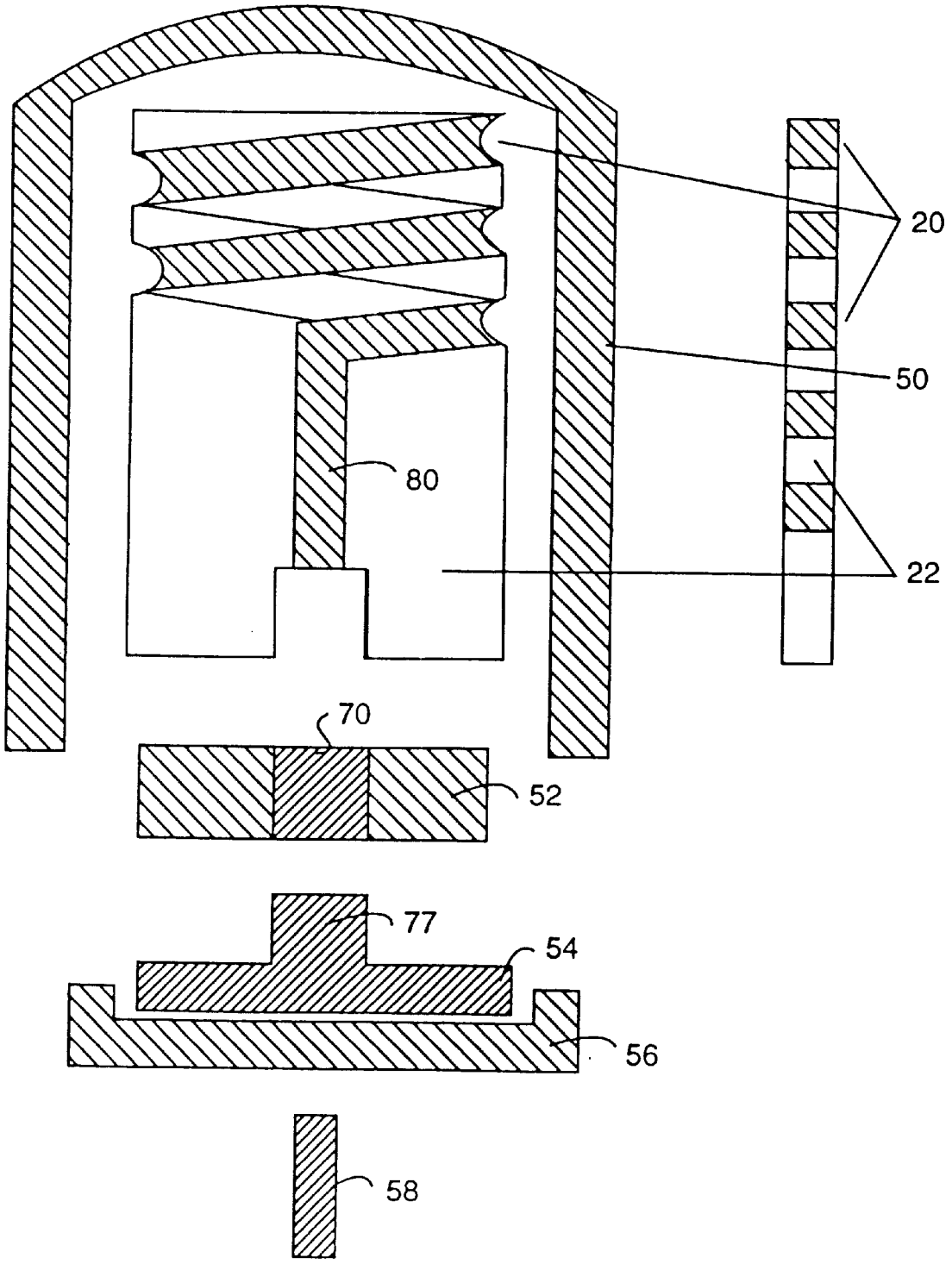
FIG. 3 is a dual cross-sectional view of an alternative embodiment of the antenna of the present invention.
Figure 4:
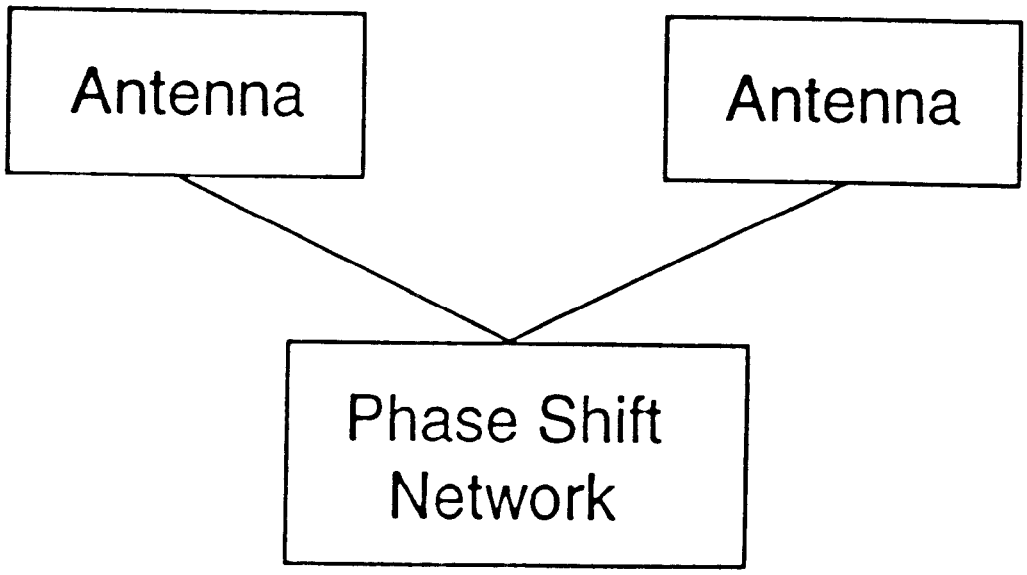
FIG. 4 shows a schematic diagram of a phase shift network using antennas of the present invention.

FIGS. 2 and 3 show alternative embodiments of the antenna of the current invention implementing a radome as well as a grounding rail (which helps to maintain constant the impedance of the antenna circuit), a center insulator, a grounding ring, and a center connecting pin for standard connection to standard antenna-receiving sockets and the like.

In FIG. 2, an antenna 20 constructed along the lines set forth above in conformance with the present invention is shown in conjunction with a radome 50, a grounding rail 52, a center insulator 54, a grounding ring 56, and a center connecting pin 58.

The radome 50 is formed in a shape generally along the lines of the antenna 20. As the antenna 20 is generally rectangular or square in shape, the radome 50 may likewise be rectangular or square in shape and generally thin in order to provide the lowest profile possible for the low visibility field diverse antenna of the present invention. The radome 50 should be constructed of weatherproof and weathertight materials such as dense plastic or the like. Additionally, such plastics may change the operating characteristics of the signals transmitted by the antenna 20. Particularly, it is known that dense plastics with a dielectric constant of 4 (such as dense acetyl plastics marketed under the brand name Delrin®), alter the operating frequency of the antenna. Such a feature may generally be taken into account in the construction and design of the present invention.

The radome 50 may be attached to a standard base known in the industry for easy connection of the antenna 20 to industry standard mounts. In conjunction with the attachment of the radome 50 to such a base, accompanying performance-enhancing components or elements can be added to the antenna of the present invention to increase and maximize its performance.

A grounding rail 52 may be added to provide the ground for the antenna 20. However, it is contemplated that the antenna of the present invention may be used with or without a ground plane and still perform well to deliver good signal transmission and communications. The grounding rail 52 may incorporate or provide a constant impedance circuit thereby widening the operating bandwidth of the transmitting antenna 20. As mentioned above, monopole antennas generally have a narrow bandwidth. By providing a bandwidth-broadening constant impedance section, the utility and operating bandwidth of the antenna of the present invention is enhanced. Additionally, signal energy impressed upon the antenna 20 is more likely to be transmitted than reflected.

The use of the ground railing 52 with a constant impedance section may eliminate the need for impedance matching in some antenna configurations and may allow for the convenient attachment of impedance matching networks and other circuits. The grounding rail 52 may be toroidal in nature and manufactured of materials known in the art. A central aperture or hole 70 present in the grounding rail 52 may provide room for a similarly circular projection 72 projecting from the center insulator 54. The center insulator 54 may also be circular in nature to provide a foundation upon which the grounding rail 52 rests and may be engaged by the center insulator's circular projection 72. A grounding ring 56 may underlie the center insulator and provide a means by which attachment can be made between the plastic insulator radome 50 and a standard industry mount or other mount.

A center connecting pin 58 connecting the transmitter to the antenna may pass through the grounding ring 56 to attach to the antenna 20 via the grounding rail 52 or otherwise. The connection of the center connecting pin 58 with any intermediating network provided by the grounding rail 52 or otherwise serves to couple the transmitter to the antenna so that the enhanced operating characteristics of the antenna 20 are available to the transmitter (not shown).

FIG. 3 shows an alternative embodiment of the present invention. The conducting foil 24 is greatly diminished in length by diminishing the length of the helix. Instead of having the helix travel from the bottommost part of the substrate 22 to its top, a center conductor 80 is present traveling upwards along a partial length of the substrate 22 until it approaches approximately the midpoint of the substrate 22. The helix then commences with the shortened helix providing a monopole antenna of diminished length and of correspondingly altered resonant frequency and other operating characteristics.

Having described the construction, operation, and utility of the present invention, specific embodiments and advantageous features of the antenna of the present invention are set forth in more detail below.

In one embodiment realized in conformance with the construction of the present invention, a short UHF antenna was constructed in a three-inch (3") high radome. This antenna, when tuned for a center frequency of 460 MHz, had a 20 MHz bandwidth with a VSWR of 2.0:1. In a second realized embodiment of the present invention, a short and wide bandwidth antenna for the 800–900 MHz frequency range was achieved. This second antenna used the geometry set forth herein and was realized in a one and three-quarter inch (1¾") tall radomed antenna having a 70 MHz bandwidth as required for the duplexed radio bands at 806–869 MHz, 824–896 MHz, and 890–960 MHz.

While ground planes are common for the current mobile antennas and small antennas (which the antenna of the present invention may replace), such ground planes are not required for good utility and operation of the present invention. For the 902–928 MHz ISM band, the present antenna delivers good performance and signal transmission without a ground plane. This band is one which is increasingly used for spread spectrum and data modem communication. Even without a ground plane, the antenna of the present invention has the property of keeping the same VSWR curve with respect to its ground plane and has near equal signal radiation in both the horizontal and vertical planes. This field diversity has been shown to usefully reject reflected interference signals.

The present invention may also be used for sub-miniature antennas for hand-held portable applications. Such antennas can be scaled in size for mounting on hand-held radios, data-modems, and the like. Such radios may be used in factories and warehouses to transmit encoded package information for inventory and shipping control. The present antenna, when mounted on the edge of a ground plane and tuned for the spread spectrum data band, exhibits similar field diversity to the ISM band antenna described immediately above.

When used without a ground plane, the horizontal signal strength of an antenna constructed along the lines of the present invention is between 0 and 3 dB below the vertical signal strength over the band. The phases are equal. With a quarter wave antenna, the horizontal signal is typically 17 to 20 dB below the vertical signal strength (−17 to −20 dB), showing the enhanced utility, performance, and operation of the antenna of the present invention.

With respect to 70 MHz bandwidth antennas, field diversity is better obtained when such antennas are mounted on the edge of the ground plane as opposed to the ground plane's center.

In an additional embodiment of the present invention, antennas constructed according to the present invention may be stacked to provide an end-fed collinear antenna array. Such an array may be driven using a phase shift network to increase the utility and benefits of the antenna of the present invention.

The response curve characteristics of antennas constructed according to the present invention include flat response curves and easily realizable manufacturing techniques. Prior to the invention of the present antenna, the performance characteristics in the band regimes addressed by the present antenna had not previously been sought or achieved. The cross-polarization, or polarization diversity, achieved by the present invention provides very reliable communications diminishing the interference patterns creating Raleigh/signal fading and dead spots. In fact, radio transmitters using antennas constructed along the lines of the present invention have been used to good advantage by stock cars racing under the auspices of the National Association for Stock Car Auto Racing (NASCAR). However, due to aerodynamic requirements, these antennas are no longer currently in use, but performed well. Additionally, other stock car racing circuits allow the use of the antenna and have found it to also perform successfully.

While the present invention has been described with regards to particular embodiments, it is recognized that additional variations of the present invention may be devised without departing from the inventive concept.

What is claimed is:

1. A low-visibility, field-diverse antenna for providing communications, comprising:

an antenna-supporting core having a width and a length; and an antenna, said antenna wrapped upon said core in a manner for a selected resonant frequency, said antenna radiating in a diverse manner with horizontal and vertical field components of a field radiated by said antenna substantially in phase and not circularly polarized; whereby the low-visibility, field-diverse antenna is realized having helical antenna characteristics without severe circular polarization radiation thereby promoting reliable communications.

2. The low-visibility, field-diverse antenna of claim 1, wherein said antenna-supporting core is generally thin and rectangular.

3. The low-visibility, field-diverse antenna of claim 2, wherein said generally rectangular shape of said antenna-supporting core approximates a square.

4. The low-visibility, field-diverse antenna of claim 2, wherein said antenna-supporting core comprises printed circuit board (PCB) substrate.

5. The low-visibility, field-diverse antenna of claim 4, wherein said PCB substrate conducts from one flat side to another via at least a portion of a plated-through hole.

6. The low-visibility, field-diverse antenna of claim 5, wherein said antenna comprises conducting foil.

7. The low-visibility, field-diverse antenna of claim 1, wherein said antenna is wrapped upon said core in a helical manner.

8. The low-visibility, field-diverse antenna of claim 1, wherein said antenna comprises a meandering conductor wrapped upon said core.

9. The low-visibility, field-diverse antenna of claim 1, further comprising:

a radome covering said core and said antenna.

10. The low-visibility, field-diverse antenna of claim 9, wherein said radome comprises a dense plastic, said dense plastic changing the operating frequency of the antenna.

11. The low-visibility, field-diverse antenna of claim 10, wherein said dense plastic has a dielectric constant of approximately 4.

12. The low-visibility, field-diverse antenna of claim 11, wherein said dense plastic is acetyl.

13. The low-visibility, field-diverse antenna of claim 9, wherein said radome is approximately three inches tall, said antenna is tuned for a center frequency of 460 MHz with a bandwidth of 20 MHz with a VSWR of 2.0:1.

14. The low-visibility, field-diverse antenna of claim 9, wherein said radome is approximately one and three-quarter inches (1¾") tall, said antenna having a bandwidth of 70 MHz for at least one of the duplexed radio bands at 806–869 MHz, 824–896 MHz, and 890–960 MHz.

15. The low-visibility, field-diverse antenna of claim 1, wherein the low-visibility, field-diverse antenna is one in a stack of similar antennas coupled by a phase-shift network creating an end-fed collinear antenna.

16. A low-visibility, field-diverse antenna for providing communications, comprising:

generally thin and approximately square antenna-supporting core comprising printed circuit board (PCB) substrate having a width and a length, said core conducting from one flat side to another via at least a portion of a plated-through hole in said core;

an antenna, said antenna comprising conducting foil fixed upon said core in a manner for a selected resonant frequency, said antenna radiating in a diverse manner with horizontal and vertical field components of a field radiated by said antenna are substantially in phase and not circularly polarized; and a radome, said radome covering said core and said antenna, said radome comprising acetyl plastic, said radome having a dielectric constant of approximately 4 and changing the operating frequency of the antenna; whereby the low-visibility, field-diverse antenna is realized having helical antenna characteristics without severe circular polarization radiation thereby promoting reliable communications.

17. A method for constructing a low-visibility, field-diverse antenna, the steps comprising:

providing an antenna-supporting core;

providing a conductor;

fixing said conductor upon said core;

attaching said conductor to said core in a manner whereby a length of said conductor is engaged by said core in a manner for a selected resonant frequency, said conductor radiating in a diverse manner with horizontal and vertical field components of a field radiated by said conductor substantially in phase and not circularly polarized; whereby the low-visibility, field-diverse antenna is realized having helical antenna characteristics without severe circular polarization radiation thereby promoting reliable communications.

18. The method for constructing a low-visibility, field-diverse antenna of claim 17, wherein the step of providing an antenna-supporting core further comprises:

providing an antenna-supporting core having plated-through holes whereby conduction can be made from one side of said antenna-supporting core to another.

19. The method for constructing a low-visibility, field-diverse antenna of claim 18, wherein the step of attaching said conductor to said core further comprises:

attaching conducting foil on one side of said core connecting one plated-through hole with another.

20. The method for constructing a low-visibility, field-diverse antenna of claim 19, wherein the step of providing an antenna-supporting core further comprises:

said plated-through holes are present on opposite sides of said core, said plated-through holes on one side of said core are offset with respect to said plated-through holes on the other side of said core to establish a pitch of said conducting foil attaching a plated-through hole on one side of said core with a plated-through hole on the other side of said core.

21. The method for constructing a low-visibility, field-diverse antenna of claim 20, wherein said offset of said plated-through holes is selected to maintain resonance in conjunction with a length of said conductor.

22. The method for constructing a low-visibility, field-diverse antenna of claim 21, wherein the step of providing an antenna-supporting core further comprises:

providing an antenna-supporting core having plated-through holes inside a perimeter margin.

23. The method for constructing a low-visibility, field-diverse antenna of claim 22, the steps further comprising:

removing excess core material by removing said perimeter margin to create a minimally-sized antenna.

24. The method for constructing a low-visibility, field-diverse antenna of claim 23, wherein said plated-through holes are approximately fifty-thousandths inch (0.050") in diameter.

* * * * *